US005911260A

United States Patent [19]

Suzuki

[11] Patent Number: 5,911,260

[45] Date of Patent: Jun. 15, 1999

[54] SQUEEGEE ASSEMBLY FOR FLOOR SURFACE CLEANING MACHINE

[75] Inventor: Masato Suzuki, Miyakoda, Japan

[73] Assignee: Amano Corporation, Kanagawa-ken, Japan

[21] Appl. No.: 08/848,461

[22] Filed: May 8, 1997

[30] Foreign Application Priority Data

May 17, 1996 [JP] Japan ..... 8-148219

[51] Int. Cl.[6] ..... A47L 13/11

[52] U.S. Cl. ..... 15/401; 15/320

[58] Field of Search ..... 15/320, 393, 401, 15/402

[56] References Cited

U.S. PATENT DOCUMENTS

| | | | |
|---|---|---|---|
| 3,520,012 | 7/1970 | Carabet et al. | 15/402 |
| 4,429,433 | 2/1984 | Burgoon | 15/401 |
| 5,377,382 | 1/1995 | Bores et al. | 15/401 |
| 5,454,138 | 10/1995 | Mondigo et al. | 15/401 |
| 5,579,555 | 12/1996 | Pearse | 15/401 |

*Primary Examiner*—Terrence R. Till

*Attorney, Agent, or Firm*—Stevens, Davis, Miller & Mosher, L.L.P.

[57] ABSTRACT

A squeegee assembly to be used in a floor surface cleaning machine includes an elongated squeegee body, a pair of flexible front and rear blades forwardly/backwardly spacedly arranged in parallel relation on the squeegee body, and a blower for applying a sucking function to an interval between the pair of flexible blades through a vacuum hose so that a dirty liquid gathered by the pair of flexible blades after cleaning is sucked up from a floor surface for collection. The squeegee assembly further includes a dirty liquid suction guide mounted on a lower part of a suction hole, which is in communication with the vacuum hose, within the cover member and adapted to guide a sucking force of the blower, which sucking force is sent through the vacuum hose, towards an inner wall surface of the rear flexible blade.

12 Claims, 5 Drawing Sheets

SQUEEGEE ASSEMBLY FOR FLOOR SURFACE CLEANING MACHINE

BACKGROUND OF THE INVENTION

1. Field of the Invention

This invention belongs to the art of a floor surface cleaning machine called "scrubber" for cleaning the surface of a floor by brushing it with a brush while traveling thereon, and more particularly, it relates to an improvement of a squeegee assembly to be used in a floor surface cleaning machine, in which a dirty liquid is sucked up from the floor surface for collection into a dirty liquid storage tank after cleaning.

2. Brief Description of the Related Art

A typical conventional squeegee assembly for the use in a floor surface cleaning machine comprises a squeegee body, a pair of flexible inner and outer blades each made of nibber material are forwardly/backwardly spacedly arranged in parallel relation on an upper surface of the bottom of the squeegee body, and a blower for applying a sucking function to an interval between the pair of blades through a tube and a hose so that a dirty liquid on the floor surface is sucked up for collection into a dirty liquid storage tank.

FIG. 8 is a sectional view for explaining a construction of the above-mentioned conventional squeegee assembly SK. In this illustration, reference character Z denotes a cover member having a configuration that is laterally elongated as a whole; X and Y, a pair of flexible blades forwardly/backwardly spacedly arranged in parallel relation within the cover member Z; E, a support member for supporting thereon the pair of flexible blades X, Y; and R, a connection port for connecting a distal end of a vacuum hose (not shown), respectively. In this conventional squeegee assembly, a suction force of the blower loaded on the floor surface cleaning machine prevails on or acts on an interval between the pair of flexible blades X, Y via the connection port R through the vacuum hole, then via a suction port R*a*, a support chamber ZH, and an inlet port E*a*, so that a dirty liquid DW gathered to the interval between the pair of flexible blades X and Y is sucked tip from the floor surface F.

In accordance with the travel of the squeegee assembly SK, the dirty liquid DW gathered into the interval between the pair of flexible blades X and Y is, as illustrated in FIGS. 8 and 9, raised in such a manner to climb up along an inner wall surface of the rear flexible blade Y, the dirty liquid DW being then partly gradually peeled off in the form of water drops W*a* as illustrated in FIG. 8 and sucked through the inlet port E*a* for collection.

However, the above conventional art has the following shortcomings in spite of its many other advantages. The dirty liquid DW, which is actually sucked through the inlet port EA for collection, is only a part (not all) of the dirty liquid DW which has climbed up along the inner wall surface of the rear flexible blade Y. Moreover, even the dirty liquid DW, which has been peeled off in the form of water drops W*a*, is not totally sucked through the inlet port E*a* and it is left as being dropped again on the floor surface F. Accordingly, a sucking efficiency is very bad, and the dirty liquid DW, which was once gathered by the pair of flexible blades X, Y, is returned to and remained on the floor surface F for long time without being sucked up.

It is true that the problem of shortage of the sucking force would be obviated to some extent by increasing the sucking force by means of a large signed blower design which is power up. However, this would eventually give rise to another problem, namely, noise. If the blower is designed to be larger in size and greater in power than necessary, noise is resultantly generated. In addition, there are other problems in that the floor surface cleaning machine is enlarged in size and the cost is increased.

The present invention has been accomplished in view of the above problems inherent in the prior art.

SUMMARY OF THE INVENTION

It is, therefore, an object of the present invention to provide a squeegee assembly to be used in a floor surface cleaning machine in which a dirty liquid can be sucked up for collection from a floor surface in relatively short time by increasing the sucking efficiency of the squeegee assembly.

In order to achieve the above object, the present invention employ the following means.

In a squeegee assembly to be used in a floor surface cleaning machine comprising an elongated squeegee body, a pair of flexible front and rear blades each made of nibber material are forwardly/backwardly spacedly arranged in parallel relation on an upper surface of the bottom of the squeegee body, and a blower for applying a sucking function to an interval between the pair of blades through a tube and a hose so that a dirty liquid gathered by the pair of flexible blades after cleaning is sucked up from a floor surface for collection, (1) there is a provision of a dirty liquid suction guide mounted on a lower part of a suction hole, which is in communication with the vacuum hose, within the cover member and adapted to guide a sucking force of the blower, which sucking force is sent through the vacuum hose, towards an inner wall surface of the rear flexible blade;

(2) there is also a provision of a dirty liquid suction guide having a cross section that is generally L-shaped, and disposed at a bottom surface of a support member for retaining the flexible blades within the cover member, with a suction port of the dirty liquid suction guide being opened backwardly, so that the sucking force of the blower sent through the vacuum hose is guided towards the inner wall surface of the rear flexible blade;

(3) the dirty liquid suction guide has a configuration that is inclined or bent with respect to the floor surface so that the suction port of the dirty liquid suction guide opening towards the inner wall surface of the rear flexible blade is gradually greatly opened towards the inner wall of the rear flexible blade; and (4) a rib-like or lug-like collection projection is disposed at the inner surface of the dirty liquid suction guide in such a manner to project therefrom so that dust, waste thread, and the like are collected in their tangled manner.

According to the means mentioned under the above item (1), the dirty liquid raised in such a manner to climb up along the inner wall surface of the rear flexible blade of the squeegee assembly upon receipt of the sucking function of the blower is sucked through the vacuum hose in a state of a continuous stream caused by the dirty liquid suction guide instead of being sucked in a state of a peeled-off water drop. Accordingly, the sucking function can extensively be increased by reducing in ratio of the dirty liquid scattering and dropping again onto the floor surface during the midway of collecting operation of the dirty liquid. This makes it possible to enhance the suction efficiency of the squeegee assembly without a need of designing the blower larger in size and greater in power.

According to the means mentioned tinder the above item (2), the sucking function of the blower acting on the interval between the front and rear flexible blades through the vacuum hose, cover member and support member is guided towards the inner wall surface of the rear flexible blade by the dirty liquid suction guide. Accordingly, the dirty liquid raised in such a manner to climb up along the inner wall surface of the blade can smoothly be guided towards the vacuum hose without changing its state of a continuous stream by the dirty liquid suction guide for collection through suction. Accordingly, the dirty liquid gathered to the interval between the front and rear flexible blades can be sucked in a comparatively short time.

According to the means mentioned tinder the above item (3), the suction port of the dirty liquid suction guide for taking therein the dirty liquid raised in such a manner to climb up the inner wall surface of the rear flexible blade is opened in such a manner to be gradually enlarged toward the inner wall surface of the rear flexible blade. Accordingly, the sucking function of the blower can effectively be acted on the inner wall surface of the rear flexible blade. Moreover, the dirty liquid raised in such a manner to climb up along the inner wall surface can smoothly and efficiently be sucked for collection.

According to the means mentioned under the above item (4), the dust, waste thread, and the like contained in the dirty liquid efficiently sucked by the dirty liquid suction guide can be collected by a rib-like or lug-like collection projection in such a manner that they are tangled around the projection. Accordingly, the vacuum hose can be prevented from being choked with the dust, waste thread and the like.

In this way, the above-mentioned object of the present invention can effectively be achieved and as a result, the problems inherent in the prior art can be obviated.

The above and other objects, features and advantages of the present invention and the manner of realizing the same will become more apparent, and the invention itself will best be understood from a study of the following description and appended claims with reference to the attached drawings showing one preferred embodiment of the invention.

DETAILED DESCRIPTION OF THE INVENTION

A squeegee assembly to be used in a floor surface cleaning machine according to the present invention will now be described in the form of one preferred embodiment with reference to the accompanying drawings.

Figure 1:
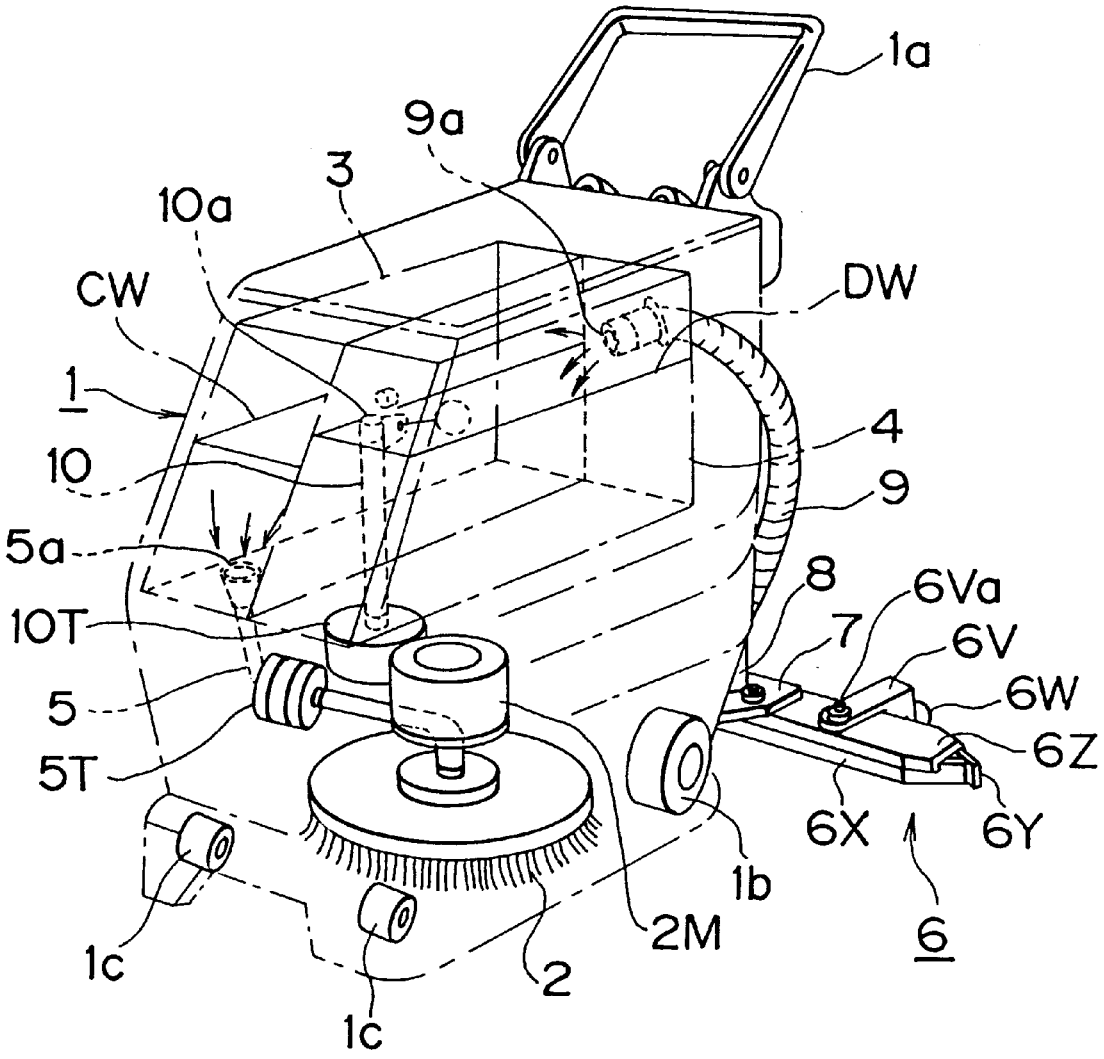
FIG. 1 is a perspective view for explaining an internal construction of a floor surface cleaning machine equipped with a squeegee assembly according to the present invention.

FIG. 1 is a perspective view for explaining an internal construction of a floor surface cleaning machine incorporated with the squeegee assembly according to the present invention. In the illustration, reference numeral 1 denotes a machine body of the cleaning machine; 1*a*, a handle for manipulation; 1*b* and 1*c*, driving wheels and front wheels; 2, a rotatable brush which is rotated for brushing the floor surface by a motor 2M; 3 and 4, a tank for a clean liquid or cleansing liquid CW and a tank for a dirty liquid DW loaded in the machine body 1; 5, and a feed liquid tube for feeding the clean liquid or cleansing liquid CW coming through an inlet port 5*a* under the effect of a pump 5T to the rotatable brush 2, respectively.

Generally denoted by reference numeral 6 is a squeegee assembly according to the present invention. A sucking force of a blower 10T to be acted on the interior of the dirty liquid tank 4 through a suction tube 10 is prevailed on the interior of the squeegee assembly which is connected to a rear portion of the machine body 1 from a distal end port 9*a*. With this sucking force, the dirty liquid remained on the floor surface is sucked for collection into the dirty liquid tank 4 by means of rotational cleaning operation of the rotatable brush 2 through the vacuum hose 9. The suction tube 10 is provided at its upper end with a suction portion 10*a* with a float valve.

Also, in the illustration, reference numeral 7 denotes a connection plate for connecting the squeegee assembly 6 to a rear portion of the machine body 1. Reference numeral 6Z denotes an elongated cover body constituting the squeegee assembly 6, and 6X, & Y denote a pair of front and rear flexible blades made of nibber material and forwardly/backwardly spacedly arranged in parallel relation within the cover body 6Z, with a lower end port of the vacuum hose 9 being connected to a connection port 8 projecting from a central area of an upper surface of the cover body 6Z. The arrangement is such that the sucking force of the blower 10T is prevailed on an interval between the front and rear flexible blades 6X and 6Y through the inside of the cover body 6Z.

Figure 2:
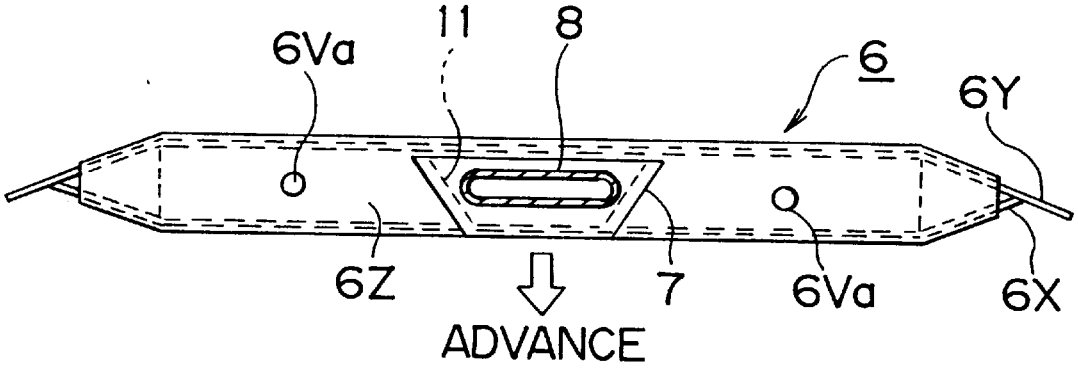
FIG. 2 is a plan view, partly in section, of a squeegee assembly according to the present invention.
Figure 3:
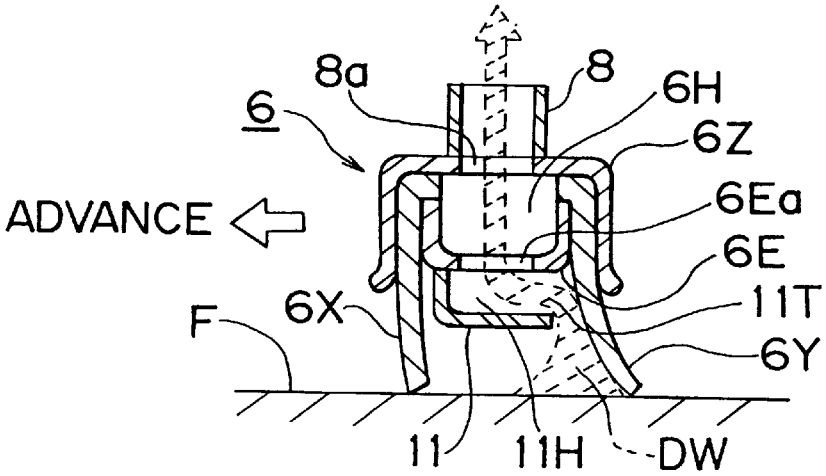
FIG. 3 is an enlarged sectional view of a squeegee assembly according to the present invention.

FIG. 2 is a plan view of the squeegee assembly 6 of the present invention, and FIG. 3 is an enlarged sectional view (forwarding time) of its main portion. In those illustrations, reference numeral 6E denotes a support member for retaining the front and rear flexible blades 6X, 6Y in parallel relation by being fitted into the interior of the cover body 6Z; 8*a* and 6E*a*, suction holes formed respectively in a bottom surface of the support member 6E and a ceiling surface of the cover body 6Z which are in alignment with the connection port 8; and 6H, an interior communication chamber of the support member 6E, respectively.

Similarly, reference numeral 11 denotes a dirty liquid suction guide attached to a bottom surface of the support member 6E in such a manner to be in alignment with the suction holes 8*a*, 6E*a*. This dirty liquid suction guide 11 has a cross-section that is generally L-shaped as a whole, so that the laterally opening suction port 11T faces the inner wall surface of the rear flexible blade 6Y. An interior chamber 11H of the dirty liquid suction guide 11 is in communication with the communication chamber 6H of the support member 6E through the suction hole 6E*a*.

Because the squeegee assembly 6 according to the present invention is thus constructed, when it is connected to a rear portion of the machine body 1 of the floor surface cleaning machine, as shown in FIG. 1, for cleaning the floor surface, the sucking force of the blower 10T coming through the vacuum hose 9 acts on the interval between the front and rear flexible blades 6X and 6Y. As a consequence, the dirty liquid DW gathered between the front and rear flexible blades 6X and 6Y after cleaning can be sucked up from the floor surface F for collection into the dirty liquid tank 4.

Figure 4:
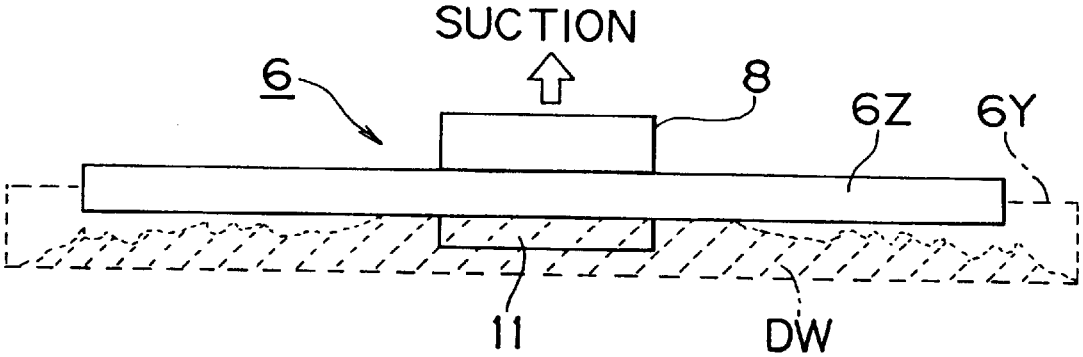
FIG. 4 is a construction diagram for explaining a sucking state of a dirty liquid by the squeegee assembly according to the present invention.

Further, because the sucking force of the blower 10T is caused to act towards the inner wall surface of the rear flexible blade 6Y by the dirty liquid guide 11, the dirty liquid DW raised in such a manner to climb up along the inner surface of the rear flexible blade 6Y can be sucked by the vacuum hose 9 and collected into the dirty liquid tank 4 by being taken into the glide chamber 11H of the dirty liquid guide 11 from the suction port 11T opening towards the inner wall surface as a continuous stream, as shown in FIGS. 3 and 4, in accordance with the progress of the squeegee assembly 6.

Figure 5:
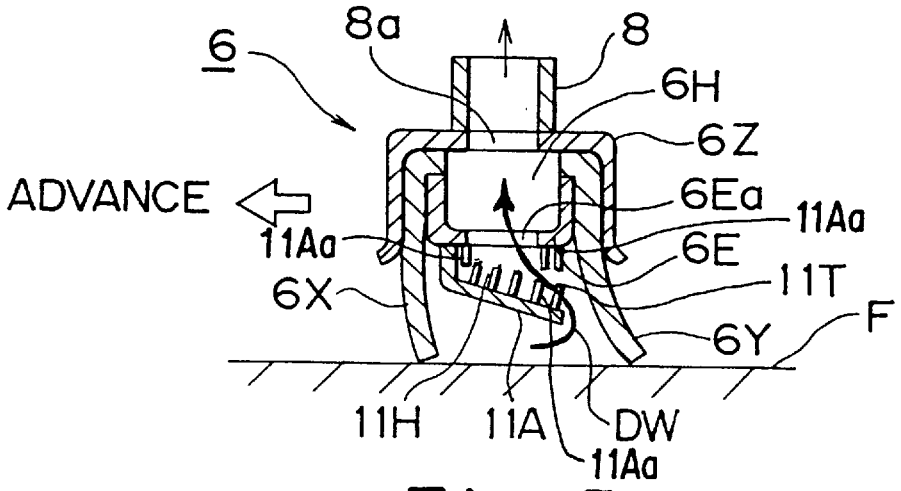
FIG. 5 is an enlarged sectional view of a squeegee assembly according to the present invention.

FIG. 5 is a sectional view showing one form of a squeegee assembly 6 according to the present invention, as claimed in claim 3. In the illustration, reference numeral 11A denotes a dirty liquid suction guide. A distal end portion of the dirty liquid guide 11A is obliquely downwardly inclined relative to the floor surface F, so that the suction portion 11T is gradually greatly opened towards the inner wall surface of the rear flexible blade 6Y. As a consequence, the dirty liquid DW can efficiently be sucked up. An interior of a guide chamber 11H of dirty liquid suction guide 11A is provided with a plurality of rib-like or lug-like collection projections 11A*a* so that dust, waste thread, and the like can be collected by being tangled on the upper and lower inner walls of the guide chamber 11H. As a consequence, the vacuum hose can be prevented from being choked with the dust, waste thread, and the like.

Figure 6:
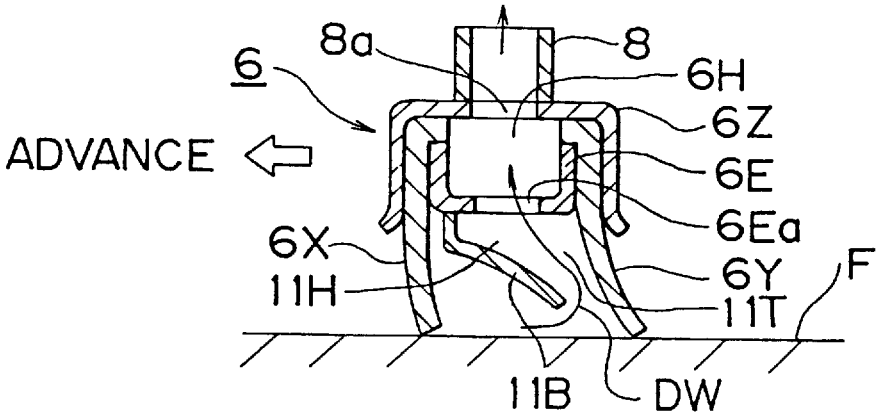
FIGS 6 and 6A are enlarged sectional views for explaining a modified embodiment of a squeegee assembly according to the present invention.
Figure 6A:
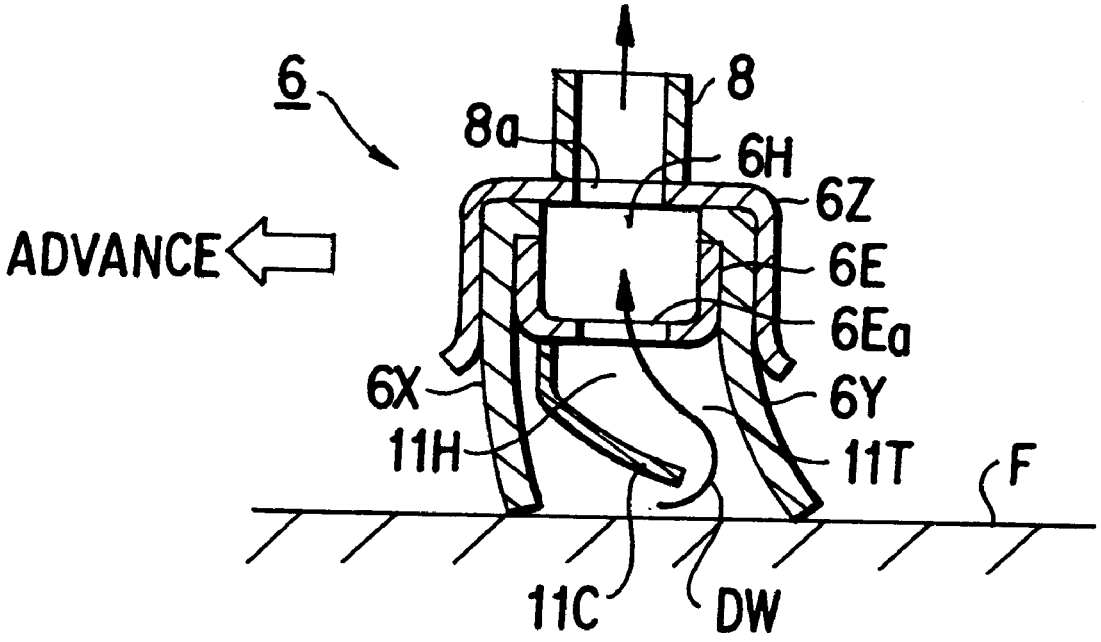
Figure 8:
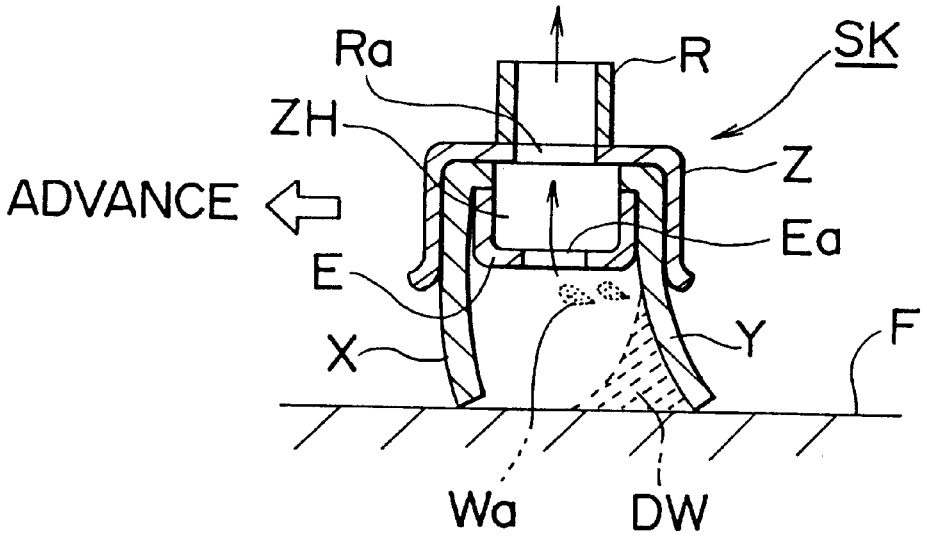
Fig. 8 (PRIOR ART)
FIG. 8 is a sectional view of the conventional squeegee assembly.
Figure 9:
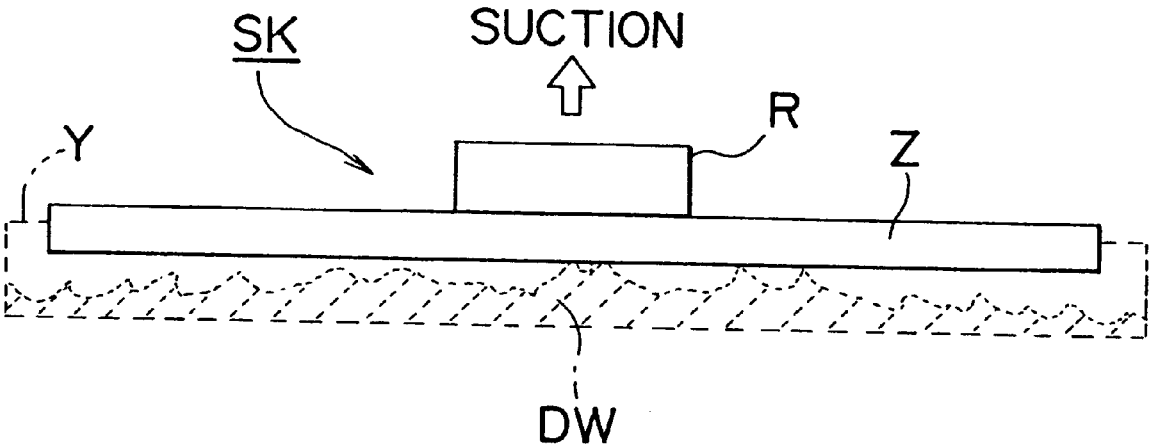
Fig. 9 (PRIOR ART)
FIG. 9 is a construction diagram for explaining a sucking state of a dirty liquid by the conventional squeegee assembly.

FIG. 6 and FIG. 6A likewise are sectional views showing other forms of squeegee assembly 6 according to the present invention. In the illustration, reference numerals 11B and 11C denote dirty liquid suction guides, respectively. The dirty liquid suction guides 11B and 11C are gently curved towards the upper surface side or the bottom surface side, so that the suction port 11T is gradually greatly opened towards the inner wall surface of the rear flexible blade 6Y. As a consequence, the dirty liquid DW can efficiently be sucked up.

Figure 7:
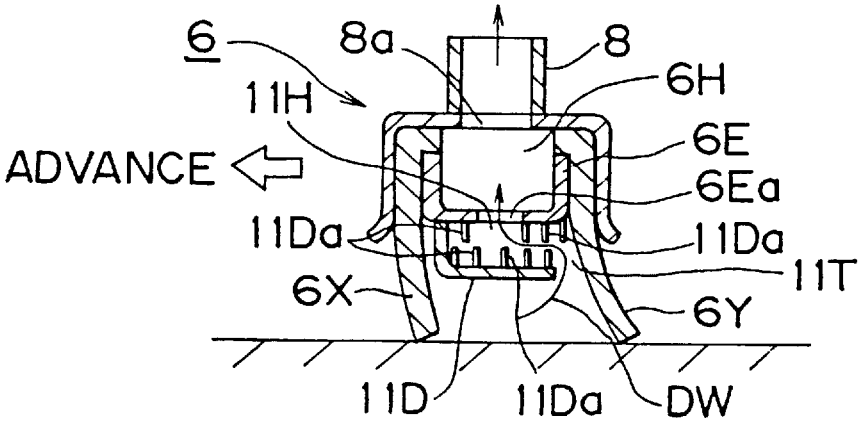
FIG. 7 is an enlarged sectional view of a squeegee assembly according to the present invention.

FIG. 7 is a sectional view showing another form of a squeegee assembly 6 according to the present invention. In the illustration, reference numeral 11D denotes a dirty liquid suction guide. An interior of a guide chamber 11 of this dirty liquid suction guide 11D is provided with a plurality of rib-like or lug-like collection projections 11D*a* so that dust, waste thread, and the like can be collected by being tangled on the upper and lower inner wall surfaces of the guide chamber 11H. As a consequence, the vacuum hose 9 can be prevented from being choked with the dust, waste thread, and the like.

In the construction of the present invention shown in FIGS. 5, 6 and 7, the members identical to those of the squeegee assembly 6 of FIGS. 2 and 3 are denoted by identical reference numerals and description thereof is omitted.

Referring back to FIGS. 1 and 2, reference numeral 6V denotes a guide wheel cover member pivotally rotatably supported on a support shaft 6V*a* projecting upwardly of the upper surface of the cover member 6Z, and 6W denotes a guide wheel of the squeegee assembly 6 attached to this cover member 6V.

Because the squeegee assembly to be used in a floor surface cleaning machine according to the present invention is constructed in a manner as described hereinbefore, it can exhibit such advantages that the sucking efficiency of a dirty liquid can be enhanced without making the blower larger in size and greater in power, and the dirty liquid gathered by the front and rear flexible blades can rapidly be sucked up in a short time. As a consequence, the floor surface cleaning operation can be increased in speed.

While some preferred embodiments of a squeegee assembly to be used in a floor surface cleaning machine according to the present invention have thus far been described with reference to the drawings, it should be borne in mind that such embodiments are merely illustrative of the gist of the present invention and are accordingly subject to modification and change.

What is claimed is:

1. A squeegee assembly to be used in a floor surface cleaning machine said assembly comprising:

an elongated squeegee body;

a front blade and a rear blade arranged in parallel relation on said squeegee body;

a blower including a vacuum hose for applying a sucking function to a space between said front and rear blades to suck up dirty liquid gathered by said front and rear blades after cleaning; and a dirty liquid suction guide disposed adjacent a lower part of a suction hole which is formed in said squeegee body and which is in communication with said vacuum hose for guiding a sucking force of said blower towards a wall surface of said rear blade within said space.

2. A squeegee assembly to be used in a floor surface cleaning machine according to claim 1, wherein said squeegee body is a cover member and said squeegee assembly further comprises:

a support member disposed within said space for retaining said flexible blades within said cover member, and wherein said dirty liquid suction guide is disposed at a bottom surface of said support member, has cross section that is generally L-shaped, and provides a suction port, so that the suction force of said blower sent through said vacuum hose is guided towards said wall surface of said rear blade.

3. A squeegee assembly to be used in a floor surface cleaning machine according to claim 2, wherein said dirty liquid suction guide provides a suction port and has a configuration that is inclined or bent with respect to the floor surface so that said suction port provided by said dirty liquid suction guide opening towards said wall surface of said rear blade is gradually opened towards said wall of said rear blade.

4. A squeegee assembly to be used in a floor surface cleaning machine according to claim 3, wherein a rib-like lug-like collection projection is disposed at the inner of surface of said dirty liquid suction guide in such a manner as to project therefrom so that debris is collected therein in a tangled manner.

5. A squeegee assembly to be used in a floor surface cleaning machine according to claim 4, wherein said debris comprises at least one of dust and waste thread.

6. A squeegee assembly to be used in a floor surface cleaning machine according to claim 2, wherein a rib-like lug-like collection projection is disposed at an inner surface of said dirty liquid suction guide in such a manner as to project therefrom so that debris is collected therein in a tangled manner.

7. A squeegee assembly to be used in a floor surface cleaning machine according to claim 6, wherein said debris comprises at least one of dust and waste thread.

8. A squeegee assembly to be used in a floor surface cleaning machine according to claim 1, wherein said dirty liquid suction guide provides a suction port and has a configuration that is inclined or bent with respect to the floor surface so that said suction port provided by said dirty liquid suction guide opening towards said wall surface of said rear blade is gradually opened towards said wall of said rear blade.

9. A squeegee assembly to be used in a floor surface cleaning machine according to claim 8, wherein a rib-like lug-like collection projection is disposed at an inner surface of said dirty liquid suction guide in such a manner as to project therefrom so that debris is collected therein in a tangled manner.

10. A squeegee assembly to be used in a floor surface cleaning machine according to claim 9, wherein said debris comprises at least one of dust and waste thread.

11. A squeegee assembly to be used in a floor surface cleaning machine according to claim 1, wherein a rib-like lug-like collection projection is disposed at an inner surface of said dirty liquid suction guide in such a manner as to project therefrom so that debris is collected therein in a tangled manner.

12. A squeegee assembly to be used in a floor surface cleaning machine according to claim 11, wherein said debris comprises at least one of dust and waste thread.

* * * * *